US005234184A

United States Patent [19]

Chew

[11] Patent Number: 5,234,184

[45] Date of Patent: Aug. 10, 1993

[54] LOCOMOTIVE AXLE MOUNTED CAB SIGNALING SENSOR

[75] Inventor: James P. Chew, Jeannette, Pa.

[73] Assignee: Union Switch & Signal Inc., Pittsburgh, Pa.

[21] Appl. No.: 799,350

[22] Filed: Nov. 27, 1991

[51] Int. Cl.[5] ..... B61L 3/24

[52] U.S. Cl. ..... 246/194; 246/34 R; 246/197

[58] Field of Search ..... 246/34 R, 34 B, 167 R, 246/187 A, 192 R, 193, 194, 196, 197, 218, 255; 104/295, 296, 297

[56] References Cited

U.S. PATENT DOCUMENTS

| | | | |
|---|---|---|---|
| 966,796 | 8/1910 | Chandeysson | 246/194 X |
| 1,302,345 | 4/1919 | Finnigan | 246/194 X |
| 1,399,796 | 12/1921 | Ross | 246/194 |
| 1,413,667 | 4/1922 | Lehmann | 246/197 X |
| 1,627,409 | 5/1927 | Rose | 246/193 |
| 2,576,424 | 11/1951 | Sunstein | 246/194 X |
| 4,451,018 | 5/1984 | Smith et al. | 246/34 R X |
| 4,655,421 | 4/1987 | Jaeger | 246/167 R |
| 4,720,067 | 1/1988 | Jaeger | 246/167 R X |

FOREIGN PATENT DOCUMENTS

| | | | |
|---|---|---|---|
| 271371 | 2/1930 | Italy | 246/255 |
| 1065399 | 4/1967 | United Kingdom | 246/194 |

OTHER PUBLICATIONS

Jan. 1978 General Mators Electromotive Division, Maintenance Instruction, p. 21.

*Primary Examiner*—Michael S. Huppert
*Assistant Examiner*—Scott L. Lowe
*Attorney, Agent, or Firm*—Buchanan Ingersoll

[57] ABSTRACT

A sensing device mounted on a railway locomotive vehicle axle assembly to sense signalling currents conducted through the axle. The device also serves to protect the critical traction motor support bearing from contamination by foreign substances. The sensing device includes a core member mounted in material at least partially covering the bearing and maintaining the core member in position encircling the axle. The core member conducts magnetic flux caused by the flow of current through the axle. An electrical conductor wound about the core member and/or a hall effect sensor embedded within the core member detect the presence of the flux. Clamping bands maintain the mounting material in position about the axle.

13 Claims, 3 Drawing Sheets

LOCOMOTIVE AXLE MOUNTED CAB SIGNALING SENSOR

BACKGROUND OF THE INVENTION

1. Field of the Invention

The present invention relates to the art of railway cab signalling pick-up sensors. More particularly, the invention relates to a device mounted on a railway locomotive axle to detect signalling information transmitted through the axle.

2. Description of the Prior Art

Traditionally, railway signalling has been provided by wayside indicators such as lights. The indicators alert the locomotive engineer of potential dangers ahead. An example of such a danger is the presence of another train stopped ahead on the track. Since it is often impossible to stop a train in less than the sight distance, it is desirable for the locomotive engineer to know of the danger before visual contact in order to avoid a problem. While wayside indicators are generally effective in providing this warning, their usefulness may be reduced during periods of fog or other inclement weather.

Since at least the early 1920s, cab signalling has been utilized to supplement discrete wayside indicators. Indicators located in the cab provide the locomotive engineer with continuous signalling information similar to that provided by the wayside indicators.

Cab signalling systems generally operate using a receiver on the locomotive inductively coupled to the track. Specifically, a pick-up coil on the locomotive senses the presence of a modulated alternating current caused by a corresponding potential applied across the track. While modulated in a manner corresponding to the aspects of the wayside indicators, the frequency of the modulated cab signalling carrier is necessarily higher than the modulation frequency to provide effective inductive coupling to the pick-up coil. It has also been necessary to mount the pick-up coils relatively close to the rails, such as on a supporting structure depending from the locomotive.

This present method of mounting pick-up coils on a structure beneath the locomotive has been found to have several disadvantages. The supporting structure itself, for example, is generally not always furnished with the locomotive, and it may be necessary to attach it later when the cab signalling system is installed. This may add significant costs to the cab signalling system. Further, the support structure is of limited utility since it has no other purpose than to maintain the coils in position near the rails. Additionally, pick-up coils mounted close to the rails may be subject to damage by debris encountered on the track. Damage to the pick-up coil and its supporting structure may often be the only damage incurred by a locomotive passing over such debris. Some pick-up coils mounted in this manner may also be somewhat unreliable since vibration of the locomotice can have a tendency to loosen the supporting structure and its associated pick-up coil.

The typical locomotive in service today is of the diesel-electric variety. Mechanical energy provided by an on-board diesel engine is converted via a generator into electrical energy to drive electric traction motors. The electric traction motors then drive the axle. The diesel-electric configuration is preferred because, unlike a diesel engine, an electric motor is capable of operating over a wide operational range without a gear changing transmission. An electric motor may also have greater torque at low speeds than a diesel engine. This greater torque can give the locomotive the ability to start with heavier loads than would otherwise be possible.

The electric traction motor is generally mounted beneath the locomotive adjacent the drive axle. A pinion gear attached to the traction motor shaft engages a drive gear mounted on the axle. Due to irregularities in the respective height of the rails at different points along the track, it is inevitable that the axle will tend to pitch around an axis transverse to the axle and longitudinal to the body of the locomotive. Because it is undesirable that the the locomotive body pitch with the axle, a suspension system is provided to isolate the locomotive body from the axle assembly. Thus, the locomotive body and the axle can have some relative movement. If the traction motor were mounted directly to the locomotive body it would be difficult for the pinion gear to maintain close mesh with the drive gear. In order to maintain this close mesh, the traction motor is mounted directly to the axle. Since the axle must rotate, however, and the traction motor must remain stationary, traction motor support bearings are provided to allow axle rotation.

Since a locomotive traction motor typically weighs at least a ton, failure of a support bearing is undesirable. Thus, the traction motor support bearing is an important component in the operation of the locomotive. The support bearing is often kept continuously lubricated by a felt wick lubricator which is immersed in an oil bath.

Occasionally, dirt or other foreign substances can work under the bearing, causing it to fail. In order to reduce the presence of such foreign substances, a bearing dust guard is utilized around the axle to cover the gap between the bearing and adjacent wheel hub.

SUMMARY OF THE INVENTION

A sensing device practicing the present invention is mounted adjacent a locomotive axle to sense electrical currents conducted from the rails through the axle. The device also serves to protect the motor support bearing from contamination by foreign substances. Specifically, the sensing device comprises a core member having a generally high electromagnetic permeability mounted in position encircling the axle. In presently preferred embodiments, the core member is situated outboard of the motor support bearing. Signal sensing means associated with the core member detect the presence of magnetic flux within the core member caused by a flow of electrical current through the axle. The core member is mounted around the axle by a mounting means which may be constructed of a resilient material. The mounting means at least partially covers the bearing, thus providing protection of the bearing from contaminants.

DETAILED DESCRIPTION

In accordance with the present invention, a railway cab signalling sensing device may be provided mounted on a railway vehicle axle assembly to detect electrical signals carried by the axle while simultaneously protecting the critical traction motor support bearing. The invention eliminates the supporting structure depending from the locomotive body which was required by prior art cab signalling pick-ups. The need for a traditional dust guard to protect the motor support bearing is also eliminated.

Figure 1:
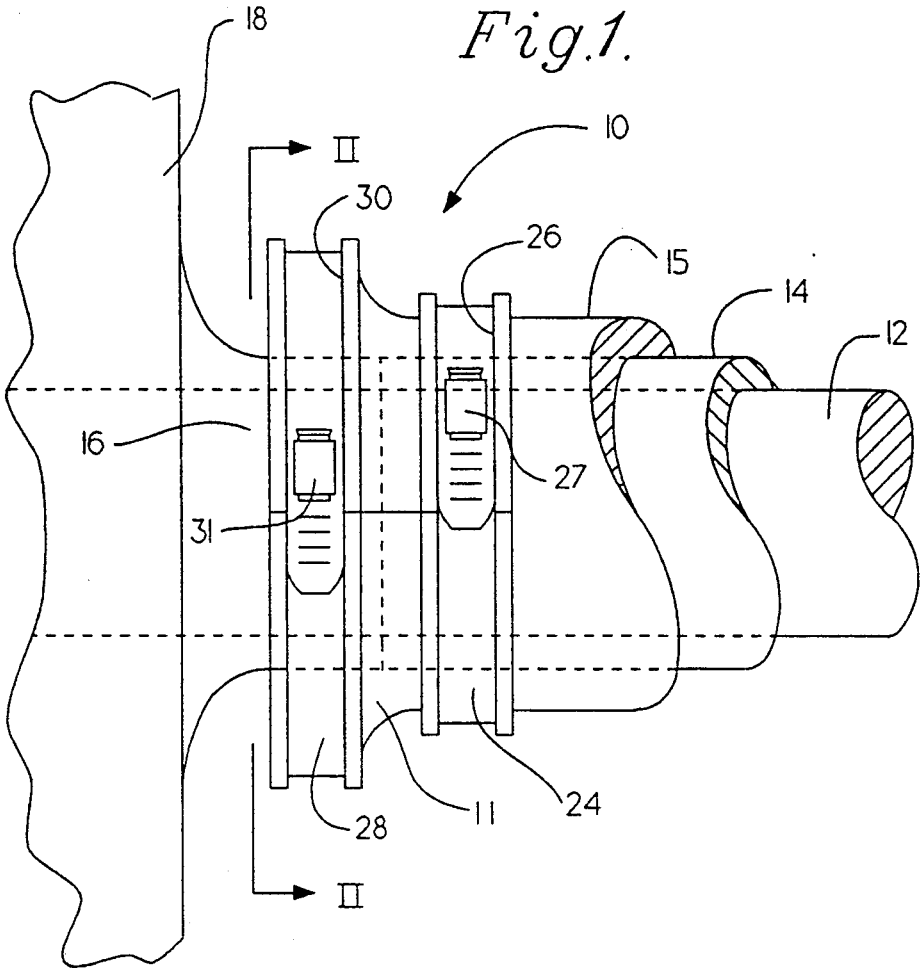
FIG. 1 is a side elevation of a presently preferred embodiment of a sensing device constructed in accordance with the invention mounted partially covering the traction motor support bearing and extending over a wheel hub as shown with broken lines.

FIG. 1 illustrates a presently preferred embodiment of a cab signalling sensor 10. Sensor 10 generally comprises a body 11 which is mounted encircling axle 12. Body 11 may be constructed of a resilient, elastomeric material. Such a resilient material tends to dampen shock to the sensor components caused by vibration of axle 12 due to irregularities in the track. Preferably, body 11 is situated partially covering traction motor support bearing 14. Support bearing cap 15, which is attached to the traction motor (not shown), may abut body 11. Body 11 also partially covers hub 16 of wheel 18, thus spanning any gap at the interface between bearing 14 and wheel hub 16. This inhibits contaminants from entering the gap and working under bearing 14. Axle 12 may typically be one foot or more in diameter while the contemplated axial width of body 11 would be that necessary to fit the apparatus.

Figure 2:
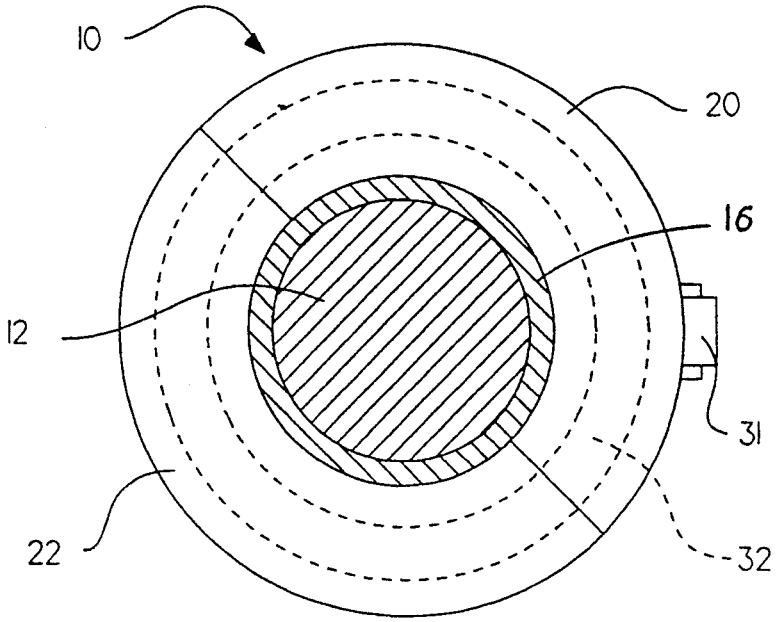
FIG. 2 is an end elevation taken along line 2—2 of FIG. 1 showing the railway vehicle axle and wheel hub in cross section and further illustrating in broken lines the annular magnetic flux conductive core member.

As shown in FIG. 2, body 11 preferably comprises at least two generally semicircular members, such as members 20 and 22, each of which surrounds generally one-half of axle 12. This facilitates easy attachment of the device. Clamping band 24, provided within circumferential clamping band recess 26, is tightened by clamping screw 27 so that body 11 will forceably engage bearing 14. Clamping band 28 is similarly provided within clamping band recess 30 and tightened with clamping band screw 31. Clamping band 28, however, is not necessarily tightened to the extent of clamping band 24 since the wheel hub 16 underneath must rotate. Clamping band 28 may provide for fit between body 11 and hub 16, or may provide stiffness or rigidity to the body 11.

Figure 3:
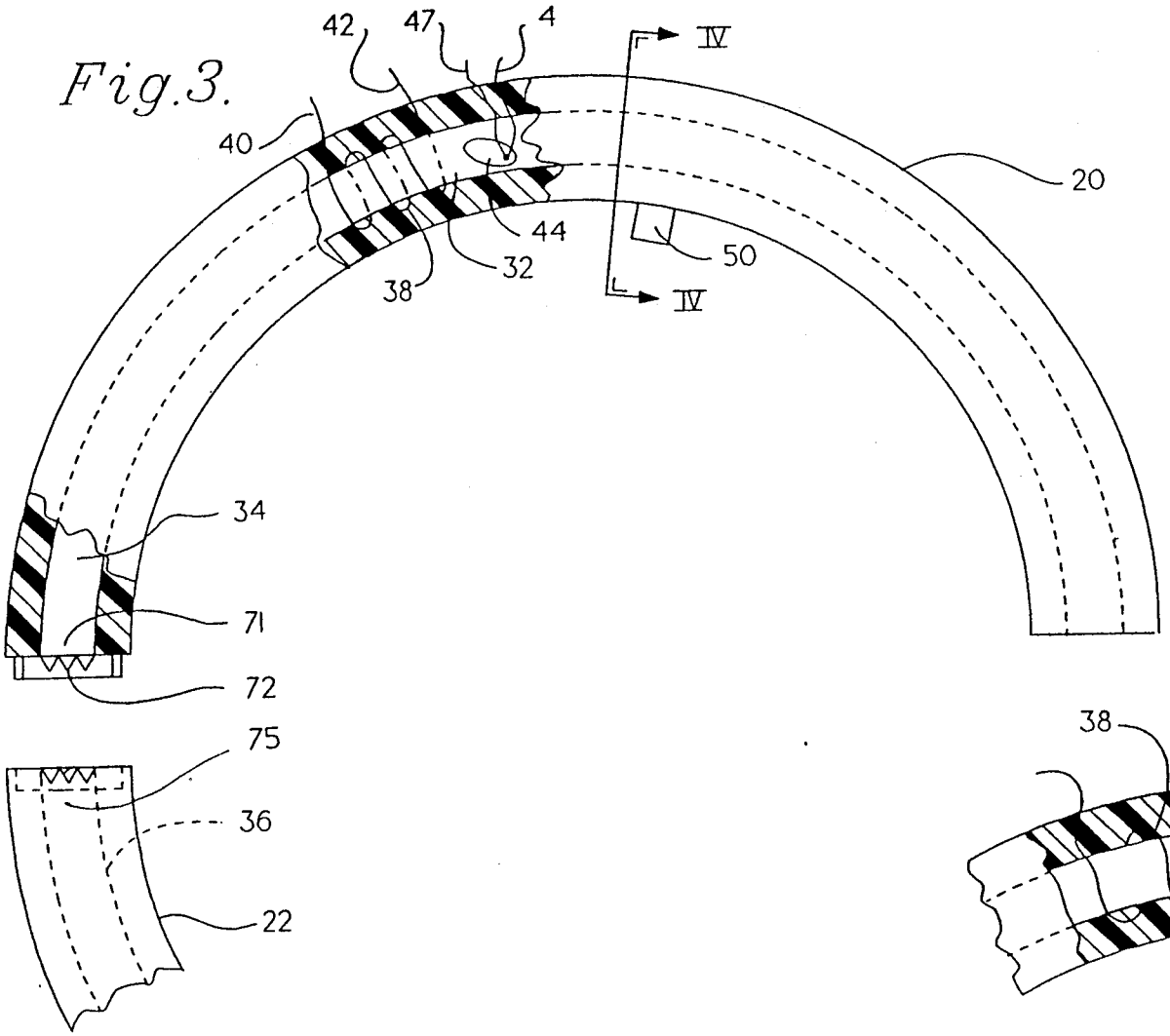
FIG. 3 is an end view of the top generally semicircular member of the sensing device showing a portion of the similar bottom semicircular member separated therefrom and further showing a cut-away view of the core member and the associated sensing means.

FIG. 3 illustrates the components of the presently preferred embodiment which detect cab signalling information. An annular core member 32 is mounted encircling a railway locomotive axle and maintained in position there by mounting means. Preferably, this is accomplished by embedding core member 32 within body 11. Core member 32 should be constructed of a material having a high magnetic permeability such as the contiguous laminated steel plates typically used in power transformers.

Since body 11 is shown configured in two semicircular members 20 and 22, core member 32 must also be divided into two corresponding semicircular half sections 34 and 36. When members 20 and 22 are united a continuous magnetic path is provided about axle 12. Thus, currents travelling through axle 12 will cause a magnetic flux in core member 32. This magnetic flux may then be detected by appropriate sensing means associated with the core member.

Figure 3A:
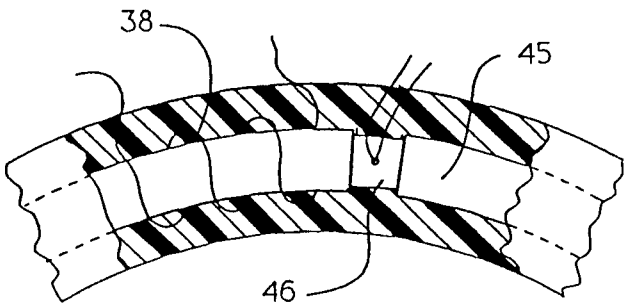
FIG. 3A is a fragmentary view illustrating an alternative embodiment of the signal sensing means of the invention.

With an AC signalling system, the signal sensing means may be a conductive winding 38 which makes at least one turn about core member 32. A time-varying flux within core member 32 will induce a voltage across lead wires 40 and 42 of winding 38 generally proportional to the magnitude of the flux and the number of the turns in the winding 38. Coded information contained in the induced voltage can then be deciphered on board the vehicle and the information contained therein utilized by the locomotive engineer. Such a winding, however, may not work with a DC cab signalling system since direct current through axle 12 may not cause a time-varying flux to travel through core member 32. For a DC system, a semiconductor flux sensitive device such as a Hall effect device may be utilized. A Hall effect device is known to have an output current dependent upon the magnitude of the direct flux passing therethrough. As shown in FIG. 3, Hall effect device 44 may be embedded within core member 32. Alternatively, as shown in FIG. 3A, a core member 45 may be provided which defines a complete angular gap in the circumference thereof. In this embodiment, a Hall effect device 46 may be mounted within and spanning the gap. Although such a configuration may somewhat lessen the permeability of the core, ease of manufacture and other practical considerations may sometimes make this configuration more efficacious than others.

It will often be desirable to provide both a winding and a Hall effect device so that sensor 10 would be compatible with most systems in use on a particular section of track. In such a situation, lead wires 47 and 48 of Hall effect device 44, for example, may be colored differently from lead wires 40 and 42 of winding 38 to enable a technician to quickly differentiate between the two.

Dowel 50 or other indexing means is typically provided depending from an inside surface of body 11. Dowel 50 is sized to be inserted into a corresponding hole in bearing 14 which is generally formed therein at the time of manufacture to facilitate placement of a dust guard. This further helps to maintain sensor 10 in position.

Figure 4:
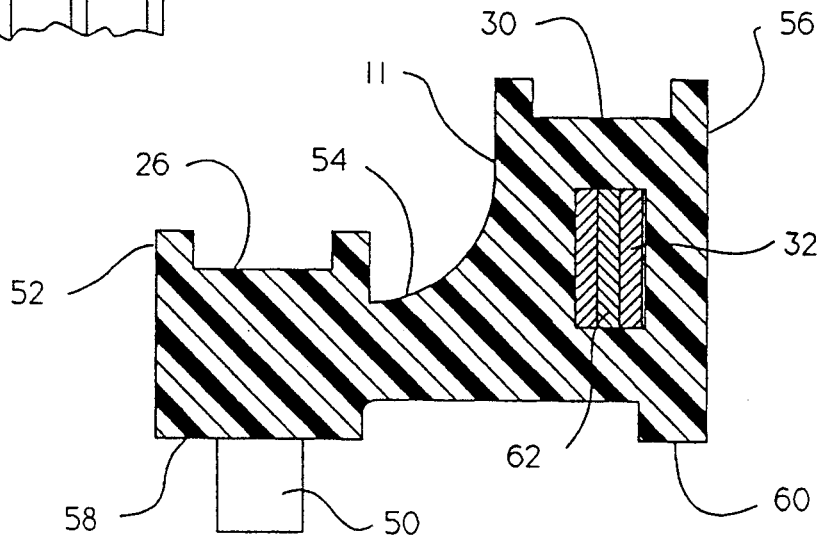
FIG. 4 is a partial cross sectional view taken along line 4—4 of FIG. 3.

Referring to FIG. 4, dowel 50 can be seen more clearly. Body 11, in the axial direction, has a first annular portion 52, an intermediate annular portion 54 integral with portion 52 and a third outer annular portion 56 integral with intermediate portion 54. Core member 32 is preferably encased within portion 56. In this way, the core member will be mounted outboard of the motor support bearing over the wheel hub 16. Greater flux within core member 32 may be thus obtained since flux-robbing bearing 14 is not between core member 32 and axle 12.

Inner sealing surface 58 of portion 52 provides sealing engagement between the sensor 10 and bearing 14 when clamping band 24 is tightened. Third annular portion 56 also has a circumferential inner surface 60 which surrounds wheel hub 16. Since hub 16 rotates with respect to sensor 10, surface 60 is preferably maintained in close proximity thereto by clamping band 28. FIG. 4 also illustrates the plurality of adjacent laminated steel plates, such as plate 62, which together make up core member 32.

Figure 5:
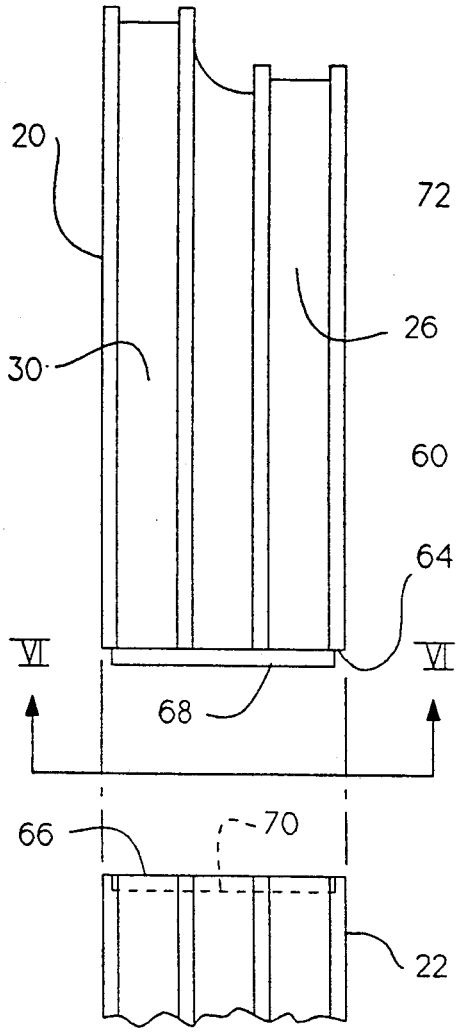
FIG. 5 is a partial side elevation of the portion of the sensing device illustrated in FIG. 3.
Figure 6:
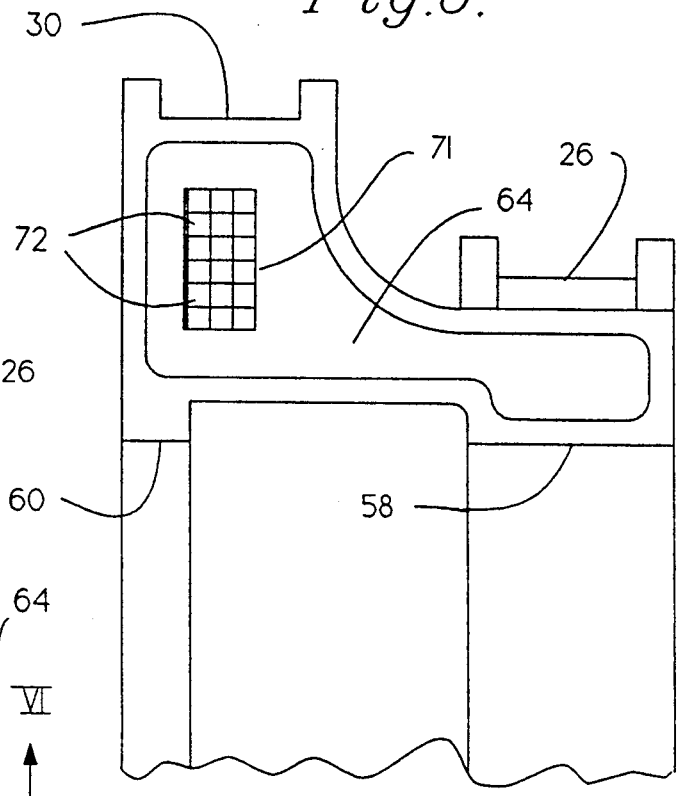
FIG. 6 is a view taken along line 6—6 of FIG. 5 of an end portion of the top generally semicircular member of the sensor body showing a terminus of the corresponding half of the core member and illustrating the plurality of pyramidal projections thereon which meshingly engage complementary projections on the terminus of the other half of the core member.

In order to prevent water or other liquid from entering the interface of members 20 and 22, which could disrupt operation of sensor 10, it is desirable to establish a generally watertight seal at this point. As shown in FIGS. 5 and 6, respective end portions of members 20 and 22, such as end portion 64 of member 20 and end portion 66 of member 22, have complementary means to provide this seal. Specifically, end portion 64 has an integral peripheral ridge 68 which, when inserted into complementary recess 70 in end portion 22, prevents liquid from penetrating the interface.

To further facilitate a continuous magnetic path for flux traveling through core member 32, the terminal portions of sections 34 and 36 are preferably configured with interlocking means to mesh opposite terminal portions when members 20 and 22 are united. FIGS. 3 and 6 illustrate one possible means of accomplishing this engagement. Terminal portion 71 of core member half section 34 is provided with a series of pyramidal projections, such as projection 72, which are complementary to similar projections in opposite terminal portion 75 of half section 36. Another embodiment uses interlocking means comprising interlocking fingers. Such fingers may be created by situating the contiguous laminated plates of core member 32 in angularly offset arrangement at the terminal portions of the semicircular halves.

It can thus be seen that a novel device has been provided for the detection of cab signalling signals transmitted through railway rails without using a pick-up coil suspended above the tracks. Concomitantly, the need for a supporting substructure for the pick-up coils has been eliminated. The present invention also protects the motor support bearing on a railway vehicle axle. Although a presently preferred embodiment has been described and shown herein, it is to be understood that various other embodiments and modifications can be made within the scope of the following claims.

I claim:

1. A railway cab signalling sensing device for detecting electrical signals carried by a railway vehicle axle assembly having an axle, traction motor support bearing and a wheel, and for protecting said bearing, said sensing device comprising:

an annular core member constructed of a magnetic flux conductive material;

resilient mounting means for at least partially covering said bearing and maintaining said core member in a position encircling said axle;

means for securing said mounting means to said assembly; and signal sensing means for detecting magnetic flux within said core member caused by said signals.

2. The sensing device of claim 1 wherein said core member is encased within said mounting means and is positioned therein to be maintained outward of said bearing.

3. The sensing device of claim 2 wherein said mounting means and said core member associated therewith are formed of a first generally semicircular member and a second semicircular member, each of said members having terminating end portions defining means for sealingly engaging respective opposite end portions.

4. The sensing device of claim 3 wherein said means for sealingly engaging respective opposite end portions comprises a peripheral ridge on one end portion engaging a complementary recess defined in an opposite end portion.

5. The sensing device of claim 3 wherein said core member defines at said end portions a plurality of pyramidal projections meshingly engaging complementary pyramidal projections in said core member at an opposite end portion.

6. The sensing device of claim 1 wherein said mounting means comprises a traction motor support bearing dust guard encasing said core member.

7. The sensing device of claim 6 wherein said means for securing said mounting means to said assembly is at least one clamping band circumferentially surrounding said dust guard.

8. The sensing device of claim 6 wherein said dust guard comprises a first annular portion having a first inner surface contacting said support bearing and providing sealing engagement therewith, an intermediate second annular portion integral with said first annular portion, and a third annular portion integral with said second annular portion, said third annular portion having a second inner surface surrounding a hub of said wheel proximate thereto, thereby reducing intrusion of contaminants under said bearing.

9. The sensing device of claim 8 wherein said means for securing said mounting means to said assembly is a first clamping band circumferentially surrounding said first annular portion and a second clamping band circumferentially surrounding said third annular portion.

10. The sensing device of claim 1 wherein said signal sensing means comprises an elongated electrical conductor making at least one turn around said core member.

11. The sensing device of claim 10 wherein said signal sensing means further comprises a Hall effect sensor embedded within said core member.

12. The sensing device of claim 1 wherein said signal sensing means comprises a Hall effect sensor embedded within said core member.

13. The sensing device of claim 1 wherein said core member defines an angular gap in the circumference thereof, said signal sensing means comprising a Hall effect sensor mounted in said gap.

* * * * *